United States Patent [19]

Burkhart et al.

[11] Patent Number: 4,604,767

[45] Date of Patent: Aug. 12, 1986

[54] WRINGER MOP

[75] Inventors: Richard P. Burkhart; Edward C. Gemperle, both of Cincinnati, Ohio

[73] Assignee: The Drackett Company, Cincinnati, Ohio

[21] Appl. No.: 695,982

[22] Filed: Jan. 29, 1985

[51] Int. Cl.[4] ..... A47L 13/12; A47L 13/144

[52] U.S. Cl. ..... 15/119 A; 15/118; 15/147 A

[58] Field of Search ..... 15/111, 114, 115, 116 R, 15/116 A, 117, 118, 119 R, 119 A

[56] References Cited

U.S. PATENT DOCUMENTS 4,491,998 1/1985 Wilson et al. ..... 15/119 A

*Primary Examiner*—Edward L. Roberts

*Attorney, Agent, or Firm*—Charles J. Zeller; Gene Warzecha

[57] ABSTRACT

A wringer sponge mop and scrubber attachment, the scrubber attachment carrying a detachable scrubber pad. The scrubber attachment may be fashioned of wire, sheet metal, a rigid plastics material or any desired combination of these materials. In the normal or use position of the sponge, the scrubber pad is positioned on one side of the sponge and rearwardly of the sponge working (floor or wall contacting) face. In the sponge wringing or squeezed position of the mop, the sponge is retracted and the scrubber pad rotates to move forwardly of the retracted sponge working face, now able to be applied to a floor or wall to be abrasively rubbed. This combination yields a mop capable of both cleaning, by brushing a liquid laden sponge over a surface, and of abrasively rubbing to effect further cleansing treatment of a surface.

13 Claims, 7 Drawing Figures

WRINGER MOP

This invention relates to wringer mops and more particularly to a wringer mop which is provided with a scrubber pad attachment to thereby enable the mop to perform the dual function of washing a floor with a mop in the normal manner, and thereafter adjusting the mop so that a scrubber pad, carrying for example an abrasive may be applied to the floor or wall being worked upon for further cleaning.

Wringer mops are already known to have evolved into a variety of forms. Such mops may be found, for example, in the following U.S. Pat. Nos. 210,953 issued to McCarthy, 2,201,079 issued to Camden, 2,203,106 issued to Rogers, 3,289,233 issued to Smyth, 3,727,259 issued to Wilson, 4,196,488 issued to Barry, 4,438,540 issued to Senour, and 4,439,885 issued to Klotz. In a typical wringer mop construction, such as those illustrated in several of the patents noted above, a mop is defined by a handle which carries at one end a mop head, the mop head carrying a sponge with the construction being such that the sponge may be squeezed to wring it out and make it ready for a fresh infusion of a cleaning liquid or to rid it of dirty liquid. With the exception of the construction illustrated by the Camden patent, wringer mops of the type carrying compressible sponges are suitable for a single purpose only. Namely, these mops carry no supplementary devices for performing any other function. In the construction illustrated in the Camden patent, a wiper blade may be attached for further wiping of a liquid from a surface being cleaned.

According to the practice of this invention in a wringer mop of the type shown generally by the Wilson and Barry patents noted above (hereby incorporated by reference) a scrubber attachment is provided, the attachment carrying a detachable scrubber pad. In normal operation of the mop, the working face of the mop sponge is available for its usual surface contacting and brushing function, with the scrubber pad being positioned at one side and rearwardly of the sponge working face. When the mop is operated so as to pull the sponge back into the mop head to thereby wring dirty liquid out of it and/or dry it, the scrubber pad attachment rotates to thereby assume a position forwardly of the retracted sponge working face, thereby making the scrubber pad available for its intended function, i.e., the further cleaning as by abrasion or by rubbing of the surface being treated.

The scrubber pad is carried by a scrubber attachment which may be easily added to a wringer type mop such as a wringer type mop constructed in accordance with the noted Wilson patent. The scrubber attachment may be fashioned of rigid wire, sheet metal, a rigid plastic material such as Teflon, or a combination of these materials.

Figure 1:
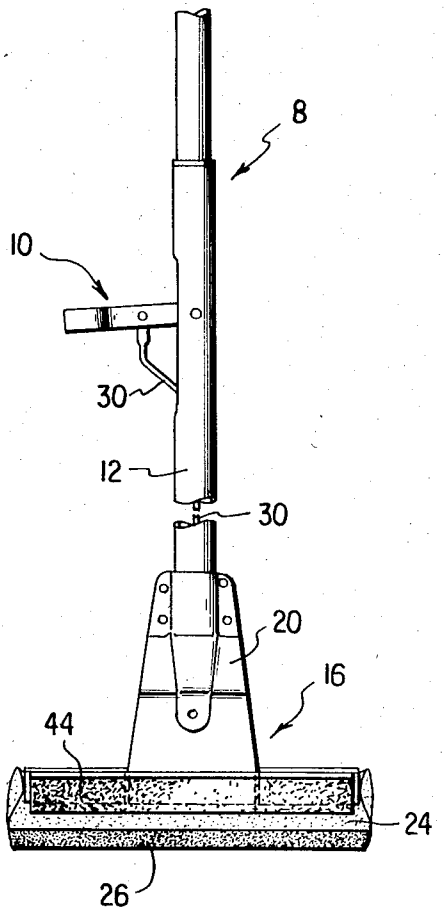
FIG. 1 is a front elevational view of the wringer mop and scrubber attachment of this invention, the mop being shown in its normal or use position.

Referring now to FIG. 1 of the drawings, the numeral 8 denotes generally the wringer mop and scrubber attachment of this invention, the mop including a means 10, including a handle for the sponge (later to be described) for retraction of the mop from its normal position to a wringing position. The mop 8 includes an elongated handle 12, with a mop head 16 at its lower end.

Figure 3:
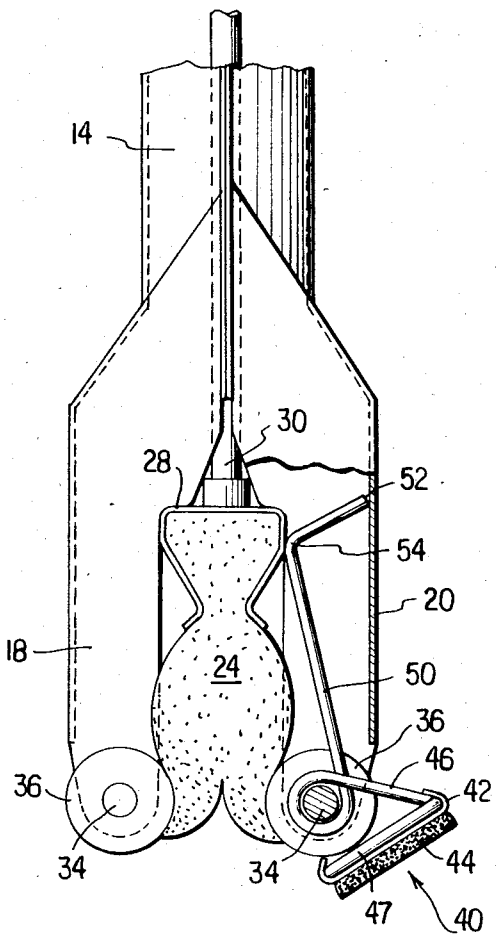
FIG. 3 is a view similar to FIG. 2, but showing the sponge in its retracted position and showing the scrubber pad as having been rotated from its normal position to its use or working position.
Figure 2:
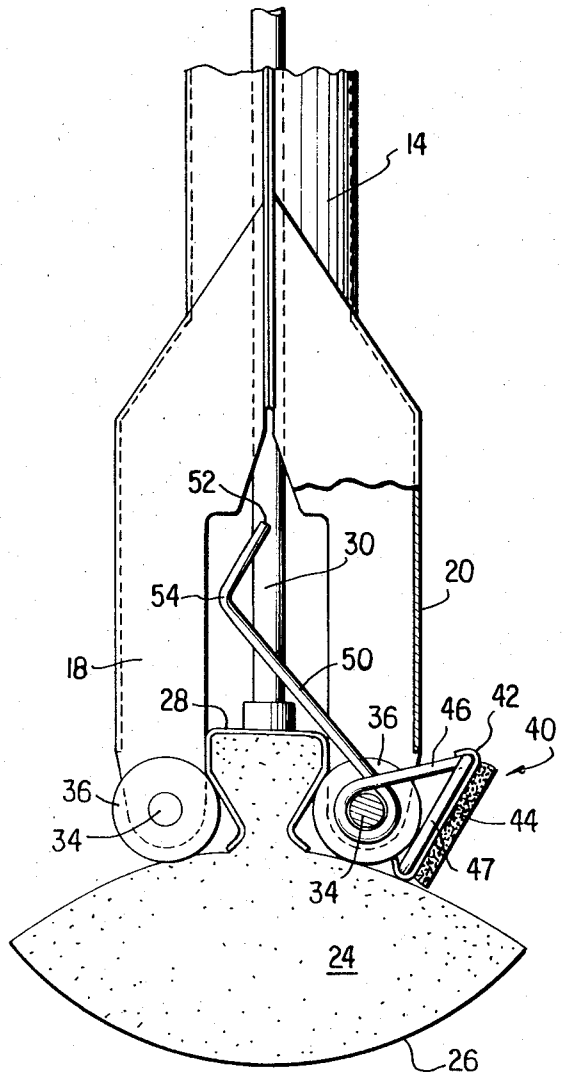
FIG. 2 is an end view of the mop of FIG. 1, partially broken away, to illustrate the relationship between the mop head, the sponge, and the scrubber attachment and the pad of this invention carried thereby.

Referring now also to FIGS. 2 and 3, the mop head 16 is defined by a generally U-shaped yoke, as formed of sheet metal, with each leg of the yoke being generally U-shaped in cross-section. The individual legs of the yoke are denoted respectively by the numerals 18 and 20. The numeral 24 denotes a sponge having a lower or working surface 26, the sponge being rigidly secured as by clamping to a rigid spine 28, the latter being fashioned, for example, of sheet metal.

The numeral 34 denotes a rigid abutment, as in the form of a metal bar or shaft which runs through complementary apertures in the ends of the legs 18 and 20 of the yoke. The numeral 36 denotes any one of a plurality of cylindrical or roller elements rotatably mounted and freely rotatable on shafts 34. The numeral 40 denotes generally the scrubber attachment and scrubber pad of this invention, and includes a channel member 42 fashioned of sheet metal or other rigid material and being of relatively narrow depth. The channel member is open at each of its two ends. The numeral 44 denotes a scrubber pad fashioned of any desired abrasive material such as steel wool, sand paper, an elastomer impregnated with abrasive particles, or the like. The pad 44 may be affixed to the channel member 42 as by an adhesive or any other convenient means.

The scrubber attachment 40 in the embodiment illustrated at FIGS. 1 to 4 is defined by rigid bent wire 46, either integral or of several wire pieces welded together, such that the end portions of the scrubber attachment 40 define a U-portions 47 over which the channel member 42 may be slid. Each one of a pair of arm members extending from U-loop portions 47 includes a loop 48, to thereby define an apertured ear, each loop 48 terminating in an extending arm portion 50. The numeral 52 denotes the free tip or end of arm portion 50, while the numeral 54 denotes a crook or bent segment thereof. The portions 46, 48 and 50 define a rigid frame member for carrying the scrubber pad assembly 42, 44. The frame defined by the bent wire is denoted by the numeral 45.

In FIGS. 1 and 2, the mop is illustrated in its normal use position, with the scrubber pad assembly or attachment 40 positioned at one side of the sponge 24 and rearwardly of it, considering the sponge face 26 to be the forward or front direction. In FIG. 3, the retracting means 10 has been operated, with rod 30, attached to the illustrated pivoted handle, having pulled rigid spine 28 upwardly to thereby wring out the sponge against abutments 34 (here carrying rollers 36) carried by the ends of legs 18, 20 of the yoke. This upward motion causes spine 28 to abut arms 50 and thereby rotate the assembly 40 clockwise to the position indicated at FIG. 3. The scrubber pad 44 has now been rotated from its rearward position and can now be employed to scrape or abrade the surface, such as a floor, being cleaned. The angle of the scrubber pad 44 with the horizontal is about 15° to about 30°, which provides a preferable angle for scrubbing for a person of ordinary height. The free ends or tips 52 of extending arm portion 50 abut yoke leg 20 in the position of FIG. 3. This abutting prevents rocking of the pad 44 about bar 34. This abutment is more than a mere touching of the tips of portion 50 and is of such force that the crook or angle 54 near the tips changes somewhat. After the pad 44 has been employed in the FIG. 3 configuration, the retracting means 10 can now be actuated in the opposite manner, to once again place the sponge 24 in the normal use position of FIG. 2. In passing from the position of FIG. 3 back to the position of FIG. 2, after wringing of the sponge, one edge of the sponge contacts one edge of the scrubber attachment to rotate the latter back to the position shown at FIG. 2. In general, the wringer operation is the same as that illustrated in the noted Wilson U.S. Pat. No. 3,727,259.

Figures 4, 5:
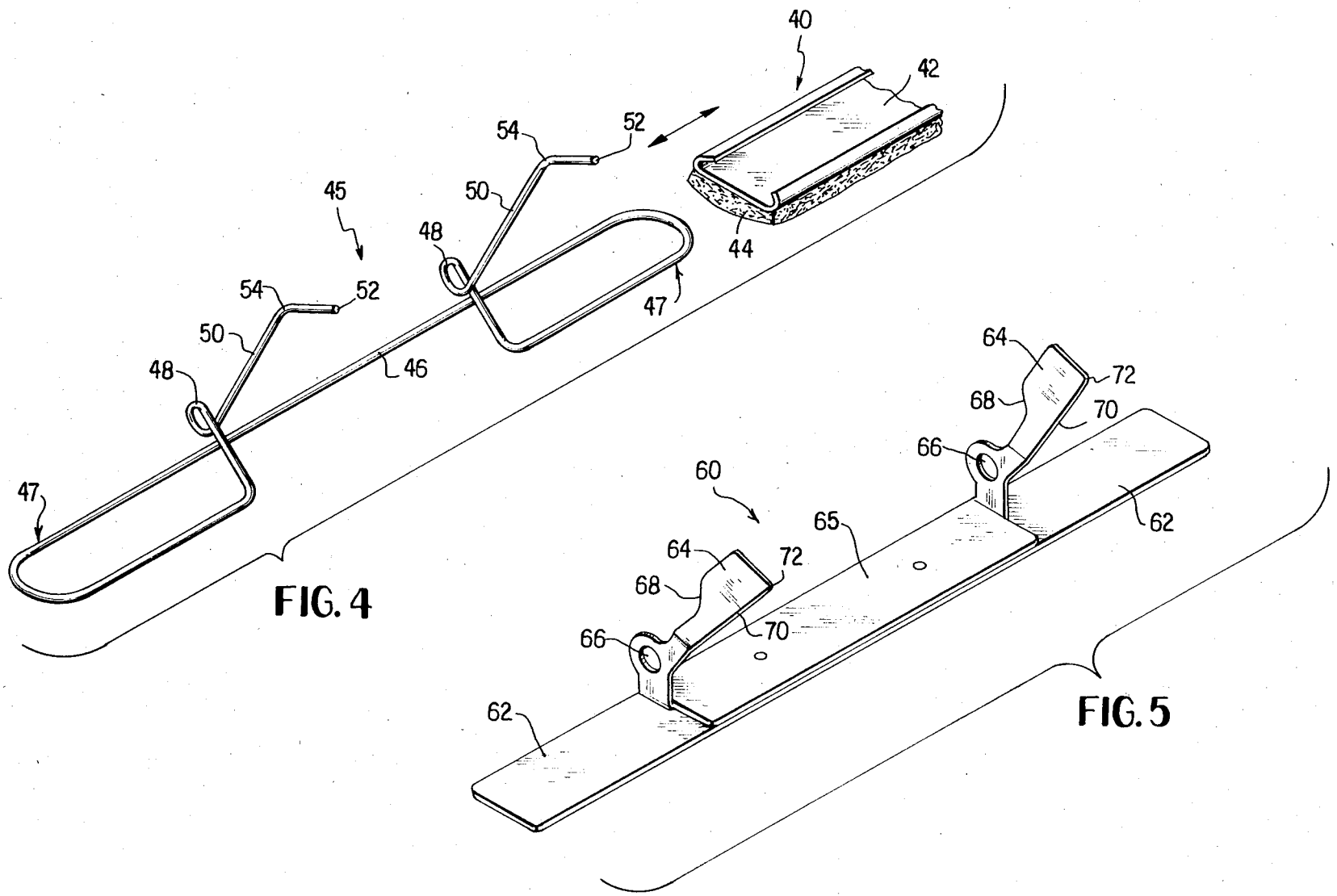
FIG. 4 is an exploded perspective view showing one embodiment of the scrubber attachment of this invention in combination with the detachable scrubber pad carried by it.
FIG. 5 is a view similar to FIG. 4 illustrating a second embodiment.

As illustrated at FIG. 4, the pad carrying channel member 42 is slidable on and off of wire frame 45. The wire frame U-ends 47 are of such a width as to frictionally yet releasably hold channel member 42.

In the scrubber attachment shown at FIG. 5 the wire frame 45 of FIGS. 1 to 4 now assumes the form of a rigid sheet metal frame 60 defined by a plate 62 carrying spaced ears 64 on one surface, ears 64 being integral ends of a base member 65 which is riveted to plate 62. Each ear is provided with an aperture 66 for the reception of one of the elongated abutments 34. Each ear has edges 68 and 70. In the retracted position of this modified scrubber pad attachment, edge 68 of each ear 64 abuts a side of rigid spine 28. In the scrubber pad use position, corresponding to the FIG. 3 mop head configuration, edge 72 of each ear abuts yoke portion 20.

Figures 6, 7:
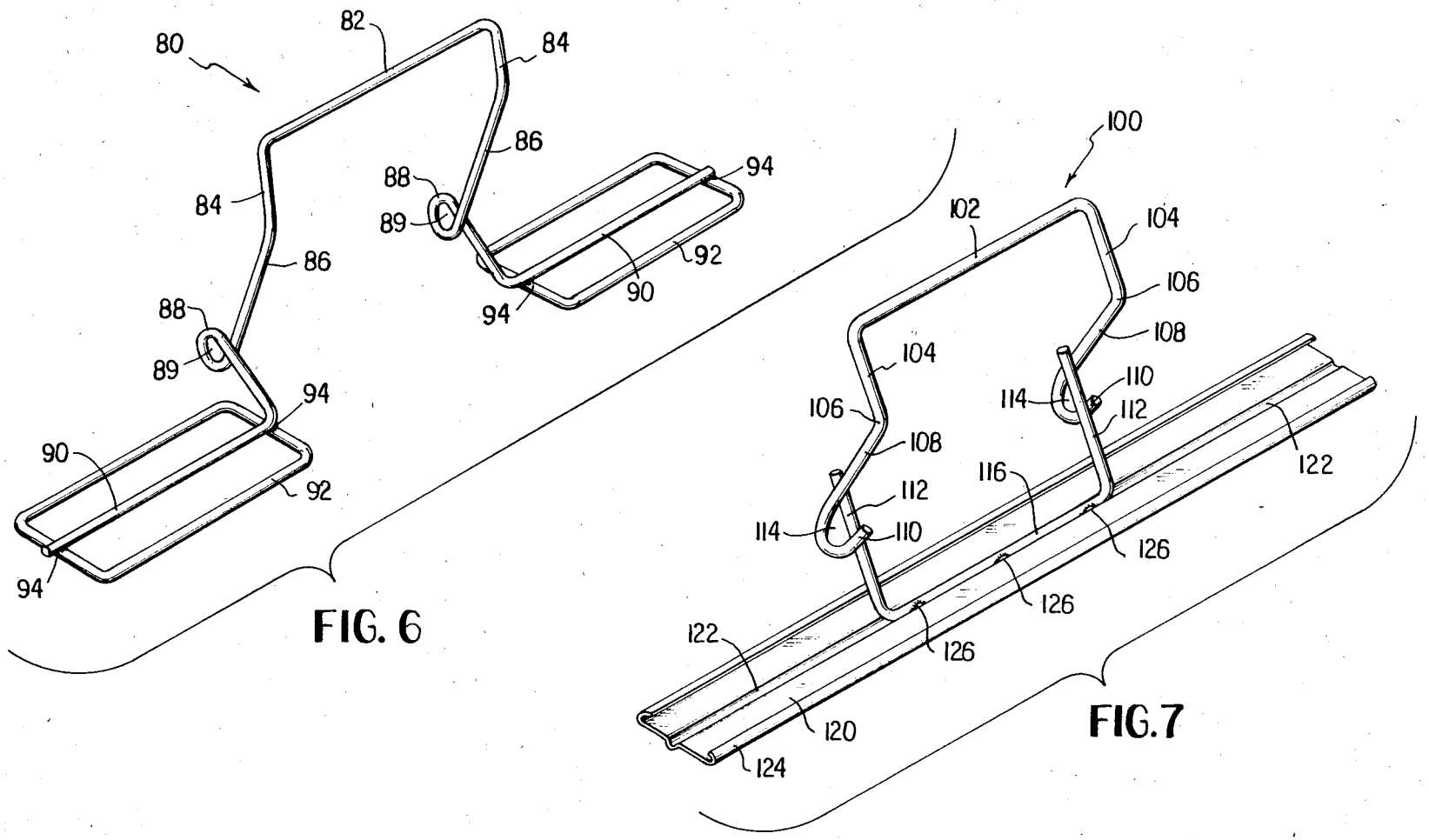
FIG. 6 is a view similar to FIG. 4 illustrating a third embodiment.
FIG. 7 is a view similar to FIG. 4 illustrating a fourth embodiment.

Referring now to FIG. 6, a third modification of the scrubber attachment is shown, this attachment being similar to previously described attachments 45 and 60. Scrubber attachment 80 is formed of stiff wire and includes a horizontal run 82 and two generally vertical runs 86, with crook or bend 84 in each of the latter. Loops 88 in runs 86 define openings 89 for the passage therethrough of rigid abutments or bars 34. Lateral and integral extensions 90 carry rectangular loops 92, of the same stiff wire construction, secured as by spot welding, the latter indicated at points 94. While not illustrated at FIG. 6, it will be immediately apparent that rectangular loops 92 carry the scrubber attachment 42, 44 in a manner completely analogous to the arrangement shown at FIGS. 1 to 4.

Referring now to FIG. 7, a fourth modification of the scrubber attachment is shown, similar to those previously described. This scrubber attachment 100 includes a horizontal run 102 of stiff wire, the ends terminating in vertical runs 104, the latter having a bend 106 and continuing to runs 108. The latter terminate in semicircular bends 110. Upwardly extending stiff wire legs 112, integral with horizontal run 116, are spot welded to bends 110 to thereby define openings 114 which receive rigid abutments or bars 34. The numeral 120 denotes a stiff, sheet metal base having a central, longitudinal running channel 122 and longitudinally running overhanding flanges 124 to provide stiffness to base 120. A plurality of spaced, swaged projections 126 on horizontal wire run 116 extend into channel 122, as does a portion of horizontal run 116, with the swaged portions 126 being spot welded to the channel sides. The base 120 receives scrubber attachment 42, 44 as shown, for example, at FIG. 4.

While the present invention has been described by means of the foregoing embodiments, reference should be had to the appended claims for a full definition of the scope of the present invention.

What is claimed:

1. A scrubbing attachment and wringer mop, the mop including a U-shaped yoke having a pair of spaced, parallel and elongated abutment members each mounted on a respective end of the U-shaped yoke, the bight of the yoke being secured to one end of an elongated handle, a mop head including a sponge having a rear portion fixedly secured to a rigid, elongated spine, the major portion of the sponge normally extending beyond the ends of the yoke, the front portion of the sponge being its working surface, the sponge having a normal thickness greater than the distance between the two elongated and parallel abutment members, means for retracting the sponge between said two abutment members towards said handle to thereby squeeze the sponge and wring out liquid therein, said scrubber attachment defined by a rigid frame carrying a scrubber pad, the rigid frame having at least one apertured ear carried thereby, said rigid scrubber frame being mounted for limited rotary oscillatory movement on one of said parallel and elongated abutment members, with said one abutment passing through said at least one apertured ear, said rigid frame carrying an arm, said spine abutting said arm when said sponge is retracted to thereby rotate said scrubber pad to a position beyond the working surface of the retracted sponge, whereby a scrubber pad mounted on said scrubber attachment may be applied to and rubbed against a surface such as a floor or a wall, which is to be cleaned and whereby the scrubber pad attachment may be rotated back to its original, non-use position above the working surface of the sponge by a reverse operation of the sponge retracting means.

2. The scrubber attachment and mop of claim 1 wherein the portion of said rigid frame which carries said scrubber attachment abuts that elongated abutment which passes through said at least one ear, at least when said sponge is retracted, to thereby support the scrubber pad in its use position when the sponge is retracted.

3. The scrubber attachment and mop of claim 1 wherein said scrubber pad is detachable from said rigid frame.

4. The scrubber attachment and mop of claim 1 wherein said elongated abutments are provided with at least one roller, the portion of the rigid frame which carries said scrubber pad abutting said at least one roller when the sponge is retracted.

5. The scrubber attachment and mop of claim 1 wherein said rigid frame carries at least two apertured ears, each apertured ear mounted on one of said parallel and elongated abutment members.

6. The scrubber attachment and mop of claim 1 wherein said rigid frame is formed of stiff wire.

7. The scrubber attachment and mop of claim 1 wherein said rigid frame is formed of sheet metal.

8. The scrubber attachment and mop of claim 1 wherein the working surface of the sponge is of such a transverse width that a portion of it contacts a longitudinal edge of the scrubber attachment upon movement of the sponge back to its normal use position, to thereby rotate the scrubber attachment to the non-use position of the latter.

9. The scrubber attachment and mop of claim 1 wherein said scrubber pad is of substantially the same length as said sponge.

10. The scrubber attachment and mop of claim 1 wherein said rigid frame is formed of stiff wire and sheet metal.

11. In a scrubber mop having a handle, a mop head at one end of the handle, the mop head carrying a sponge and spaced parallel rollers, means for moving said sponge relative to said head for squeezing said sponge between said spaced parallel rollers to wring out liquid therein, a scrubber attachment carrying a scrubber pad thereon mounted for rotation on said head, said scrubber pad being normally positioned on one side of said sponge and rearwardly of the working face of the sponge, the improvement comprising an extended member affixed to said scrubber attachment and adapted to be engaged by said sponge and rotated on said head directly by said sponge as it is moved for wringing it out, said scrubber pad thereby moving to a position forwardly of the working face of said sponge, whereby said scrubber pad may be applied to and rubbed against a surface such as a floor or a wall which is to be cleaned when said sponge is in its squeezed position relative to said mop head.

12. A scrubber mop according to claim 1 wherein said arm is, when said sponge is fully retracted, simultaneously abutting said spine and said yoke in order to prevent any rotation of said rigid frame about said one of said parallel and elongated abutment members.

13. A scrubber mop according to claim 11 wherein said mop head further comprises a yoke having a leg and wherein said sponge is retracted into said yoke in order to wring it out and wherein said extended member is, when said sponge is fully retracted, in abutment with said sponge and a predetermined portion of said leg in order to prevent rotation of said extended member relative to said mop head while said sponge is fully retracted.

* * * * *